US007814897B2

(12) United States Patent
Larsen

(10) Patent No.: US 7,814,897 B2
(45) Date of Patent: Oct. 19, 2010

(54) DOOR LINKAGE SYSTEM FOR AN OVEN HAVING FRENCH-STYLE DOORS

(75) Inventor: Christopher A. Larsen, Cleveland, TN (US)

(73) Assignee: Maytag Corporation, Benton Harbor, MI (US)

( * ) Notice: Subject to any disclaimer, the term of this patent is extended or adjusted under 35 U.S.C. 154(b) by 1435 days.

(21) Appl. No.: 11/206,219

(22) Filed: Aug. 18, 2005

(65) Prior Publication Data

US 2007/0039605 A1 Feb. 22, 2007

(51) Int. Cl.
*F24C 15/04* (2006.01)

(52) U.S. Cl. ..... 126/191; 126/190; 126/197; 49/366; 49/367; 49/368; 110/173; 292/201

(58) Field of Classification Search ..... 126/191, 126/190, 197; 110/173; 16/278, 374; 49/113, 49/109, 367, 366, 368, 369; 292/201, 192, 292/194

See application file for complete search history.

(56) References Cited

U.S. PATENT DOCUMENTS

| | | | | | |
|---|---|---|---|---|---|
| 370,849 | A | * | 10/1887 | Baxter | 126/191 |
| 2,025,480 | A | | 12/1935 | Sponsler | |
| 2,601,604 | A | * | 6/1952 | Ford | 49/109 |
| 2,707,225 | A | | 4/1955 | Pearce | |
| 2,708,709 | A | | 5/1955 | Pearce | |
| 2,823,664 | A | | 2/1958 | Evans et al. | |
| 2,836,268 | A | | 5/1958 | Evans | |
| 2,889,825 | A | | 6/1959 | Evans et al. | |
| 3,009,458 | A | | 11/1961 | Pearce | |
| 3,091,232 | A | | 5/1963 | Allen, Jr. et al. | |
| 3,409,003 | A | | 11/1968 | Rehberg et al. | |
| 3,409,004 | A | | 11/1968 | Rehberg | |
| 3,707,145 | A | | 12/1972 | Anetsberger et al. | |
| 4,090,273 | A | * | 5/1978 | Hurst, Jr. | 16/333 |
| 5,471,972 | A | | 12/1995 | Corliss, II et al. | |
| 5,584,284 | A | | 12/1996 | Corliss, II et al. | |
| 5,988,154 | A | | 11/1999 | Douglas et al. | |
| 6,250,014 | B1 | * | 6/2001 | Rusiana | 49/367 |

* cited by examiner

*Primary Examiner*—Steven B McAllister
*Assistant Examiner*—Avinash Savani
(74) *Attorney, Agent, or Firm*—John W. Morrison; Diederiks & Whitelaw PLC

(57) ABSTRACT

A cooking appliance includes first and second French-style doors connected through a door linkage system. The door linkage system includes first and second control arms, each including a first end linked to a corresponding one of the first and second doors and a second end. The second ends of the first and second control arms are interconnected and mounted so as to travel in an arcuate path when one of the doors is operated. Shifting one of the first and second doors in an open or closed direction results in a corresponding movement in the other door. The first and second control arms are actually interconnected to a linkage control arm that establishes a particular timing of the doors. The door linkage system also employs a camming surface, cam follower and spring element that provides a biasing force to the doors.

21 Claims, 8 Drawing Sheets

DOOR LINKAGE SYSTEM FOR AN OVEN HAVING FRENCH-STYLE DOORS

BACKGROUND OF THE INVENTION

1. Field of the Invention

The present invention pertains to the art of cooking appliances and, more particularly, to a door linkage system for an oven having French-style doors.

2. Discussion of the Prior Art

It is widely known to provide a cooking appliance, such as an oven range or a wall oven, with a single, generally rectangularly shaped door that pivots about a horizontal axis. That is, a top portion of the oven door is pulled outward from the appliance about horizontally disposed hinges and lowered into a horizontal position to provide access to the oven cavity. While this type of oven door has found wide spread use, it is not entirely satisfactory for every application. For instance, an oven door that rotates about a horizontal axis projects outward from the appliance a considerable distance. This distance must be taken into consideration when deciding where to locate the appliance in the kitchen. Otherwise, the opened door could interfere with traffic patterns in the kitchen or with access to other cabinetry. In addition, such an oven door may require a consumer to stand at a side of the appliance to fully access the oven cavity. In order to address this problem, some manufacturers provide their ovens with one or more doors that swing open about substantially vertical axes.

Incorporating French-style doors into cooking appliances is also known in the art. An oven employing French-style doors will typically include a linkage that translates linearly so as to cause both of the doors to open or close when either one of the doors is operated. In this manner, the doors can be operated with only one hand, leaving the other hand free to hold a food item. While this type of door arrangement does address many of the shortcomings associated with horizontally swinging doors, French-style doors include several shortcomings of their own. For example, proper door sealing to avoid excessive heat loss from the oven cavity is an important concern. In at least arrangements employing doors which interengage when closed, in order for the doors to close and seal properly, one of the doors must lag relative to the other. In this manner, a proper seal can be maintained about the oven cavity without requiring a consumer to close each of the doors separately. Moreover, the linkage must properly retain the doors in the closed position in order to ensure that hot oven gases do not escape. Other areas of concern include providing end stops or detents so that the doors do not inadvertently swing shut.

Therefore, despite the existence of French-style doors employed in cooking appliances of the prior art, there still exists a need for an improved door linkage system for a French-style oven door arrangement. More specifically, there exists a need for a linkage system that can be adjusted to alter closure timing of the doors, exert a suitable sealing force upon the doors, and minimize pinch points for the linkage system.

SUMMARY OF THE INVENTION

The present invention is directed to a door linkage system for a cooking appliance. In accordance with the invention, the cooking appliance includes a cabinet shell and an oven cavity arranged within the cabinet shell, with the oven cavity having top, bottom, rear and opposing side walls that collectively define a frontal opening. The cooking appliance is provided with first and second doors that are pivotally mounted relative to the cabinet shell for selectively closing the frontal opening of the oven cavity. More specifically, the first and second doors constitute French-style doors that open about substantially vertical axes.

In accordance with one preferred embodiment of the invention, the first and second doors are interconnected through the door linkage system. More specifically, the door linkage system interconnects each of the first and second doors to one another, as well as with the cabinet shell. The door linkage system includes a first door control arm having a first end, which is pivotally mounted to the first door, and a second end. The door linkage system also includes a second door control arm having a first end, which is pivotally mounted to the second door, extending to a second end that is pivotally connected to the second end of the first door control arm.

In further accordance with this preferred embodiment of the invention, the second ends of the first and second door control arms are mounted in such a manner so as to travel in arcuate paths when either one of the first and second doors is operated. More specifically, when one of the first and second doors is moved in either an opening or a closing direction, the second ends of the first and second door control arms travel over the arcuate paths, causing the other of the first and second doors to move in a corresponding direction.

At least one of the door control arms has associated therewith a camming surface upon which rides a corresponding cam follower as the doors transition between open and closed positions. In accordance with one form of the invention, the cam member is actually incorporated into one or both of the door control arms. In accordance with another form of the invention, the cam member is a distinct unit operatively coupled to a respective door control arm. Preferably, a pair of cam followers pivot relative to the cabinet shell through a tensioning bracket and are spring biased towards each other. In any event, the overall cam follower arrangement provides a sealing force to the first and second doors in the closed position. Additionally, the camming surface is provided with a plurality of detents that establish various, selectable positions for the doors. That is, the detents engage with the cam followers in order to selectively retain the first and second doors at any one of various locations ranging from a fully open position to a fully closed position, with at least one detent residing at the fully open position to ensure that the first and second doors do not inadvertently swing closed.

In still further accordance with the present invention, the first and second control arms are operatively connected to a support bracket through a linkage control arm. In accordance with one form of the invention, the second ends of the first and second door control arms are secured to the linkage control arm so as to pivot about a single pivot point while, in another embodiment of the invention, the second ends of the door control arms pivot about separate pivot points. In any case, the linkage control arm establishes the arcuate path tracked by first and second ends of the door control arms, as well as a particular time of the doors. The camming surface can be formed as a portion of the support bracket. In addition, the tensioning bracket and cam followers are pivotally mounted to the support bracket. With this arrangement, as the doors transition between the open and closed positions, the linkage control arm engages the cam follower. The cam follower travels along the camming surface to provide for a smooth transition.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
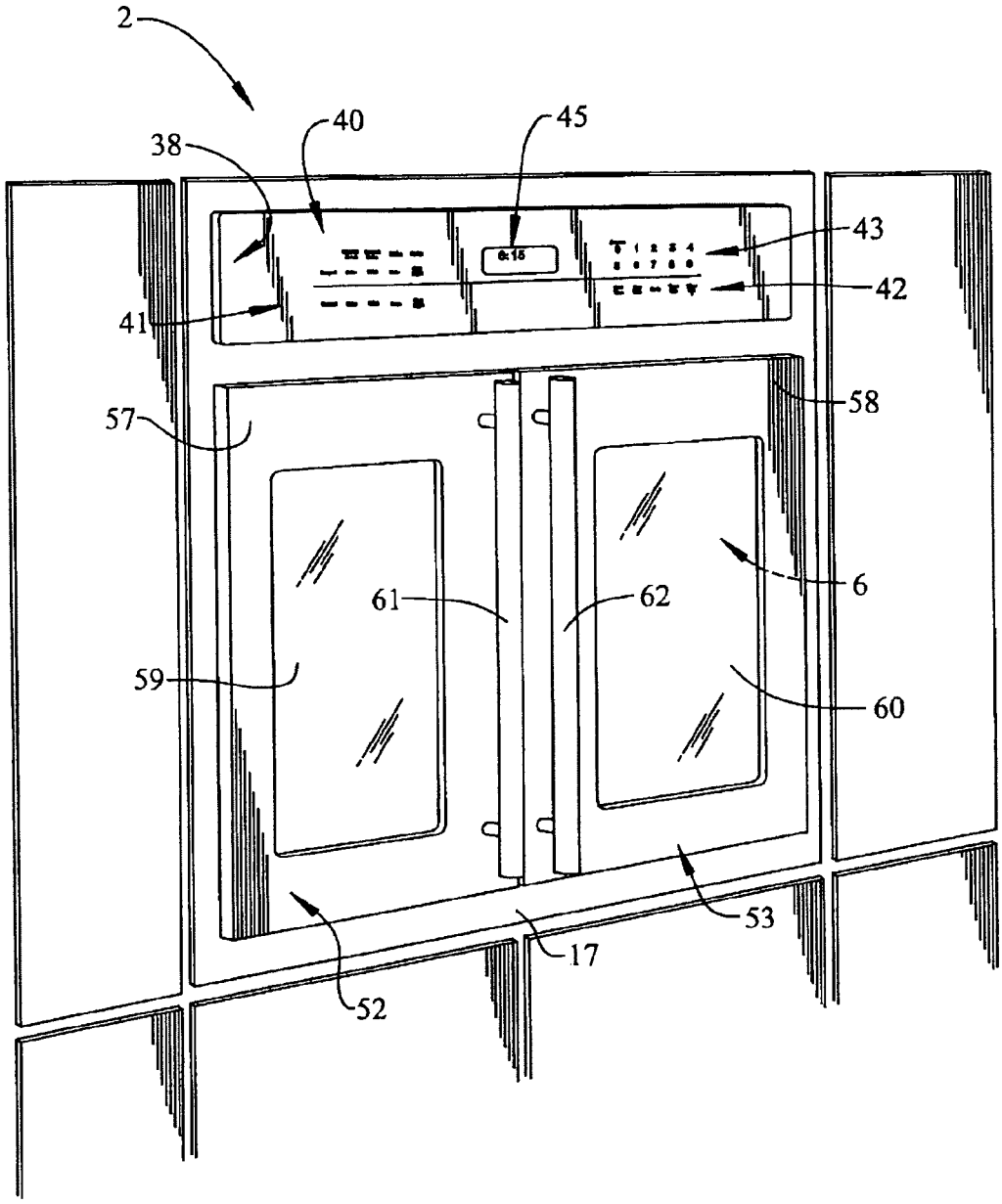
FIG. 1 is a left perspective view of a cooking appliance including French-style doors constructed in accordance with the invention, with the doors being shown in a fully closed position.
Figure 2:
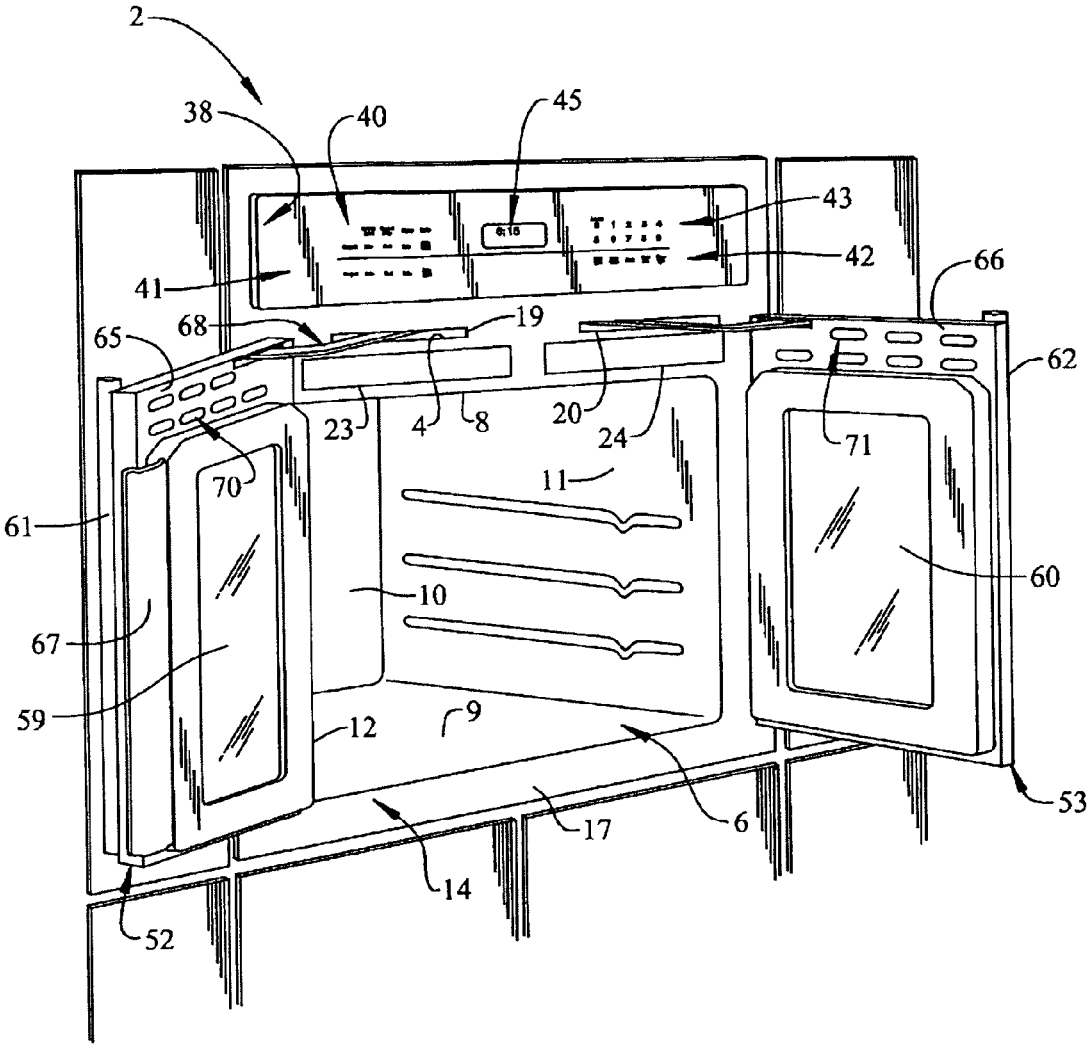
FIG. 2 is a left perspective view of the cooking appliance of FIG. 1 illustrated with the French-style doors in a fully open position.

With initial reference to FIGS. 1 and 2, a cooking appliance constructed in accordance with the present invention is generally indicated at 2. As depicted, cooking appliance 2 constitutes a wall oven. However, it should be understood that the present invention is not limited to this particular model type and can be incorporated into various types of oven configurations, e.g., cabinet mounted ovens, as well as both slide-in and free-standing ranges. In any event, in the embodiment shown, cooking appliance 2 constitutes a single wall oven unit including a frame 4 (best seen in FIG. 3) that supports, at least in part, an oven cavity 6. Oven cavity 6 includes a top wall 8, a bottom wall 9, a rear wall 10 and opposing side walls 11 and 12 that collectively define a frontal opening 14. In a manner known in the art, frontal opening 14 is surrounded by a face frame portion 17 which provides an overall aesthetic finish to cooking appliance 2. Preferably, face frame portion 17 is provided with first and second openings 19 and 20 which, as will be discussed more fully below, lead to frame 4. Face frame portion 17 is also provided with additional openings 23 and 24 that form part of an overall airflow system of cooking appliance 2.

In a manner known in the art, cooking appliance 2 includes a control panel 38 having a plurality of control elements. In accordance with the embodiment shown, the control elements are constituted by first, second and third sets of oven control buttons 40-42, as well as a numeric pad 43. Control panel 38 is adapted to be used to input desired cooking parameters and establish operating conditions for cooking appliance 2. More specifically, first, second and third sets of control buttons 40-42, in combination with numeric pad 43 and a display 45, enable a user to establish particular cooking operations that are performed within oven cavity 6. As the oven control is known in the art and does not form part of the present invention, it will not be discussed further herein.

In accordance with the invention, cooking appliance 2 is provided with French-style doors that are adapted to selectively seal across frontal opening 14. More specifically, cooking appliance 2 includes a first door 52 and a second door 53 that are pivotally mounted relative to frame 4 and adapted to be moved from a fully closed position, as represented in FIG. 1, to a fully open position, as represented in FIG. 2, to provide access to oven cavity 6. As shown, doors 52 and 53 swing outward about substantially vertical axes established by upper hinges 54 and 55 (FIG. 3) and lower hinges (not shown).

In a manner known in the art, each door 52, 53 is provided with a corresponding outer panel 57, 58 having a respective central transparent zone or window 59, 60. In addition, each door 52, 53 is provided with a corresponding handle 61, 62 that enables a consumer to shift doors 52 and 53 between open and closed positions. In order to provide a proper seal about frontal opening 14, each door 52, 53 includes an inner panel 65, 66 about which extends a peripheral seal (not shown). In addition, first door 52 is provided with a flange 67 that serves as an intermediate sealing surface for second door 53. That is, when both first and second doors 52 and 53 are moved to the closed position of FIG. 1, flange 67 traverses an intermediate gap or opening (not separately labeled) laterally between doors 52 and 53. Although not part of the present invention, doors 52 and 53 are shown to include a plurality of openings indicated generally at 70 and 71 on inner panels 65 and 66. Openings 70 and 71 allow a flow of air to pass from within doors 52 and 53 into openings 23 and 24 and around oven cavity 6. The airflow minimizes the conduction of heat from oven cavity 6 to outer panels 57 and 58 of doors 52 and 53. In any event, in order to provide a consumer easy access to oven cavity 6, cooking appliance 2 is provided with a door linkage system 68 (FIG. 2) that interconnects first and second doors 52 and 53. Linkage system 68 operates such that movement of either one of first and second door 52 and 53 causes the other one of first and second doors 52 and 53 to move or shift in a corresponding manner as will be detailed more fully below.

Reference will now be made to FIGS. 3-6 in describing a first preferred embodiment of door linkage system 68. As shown, door linkage system 68 includes a first control arm 80 having a first end 82 pivotally connected to first door 52. First end 82 extends, through opening 19 in face frame portion 17, to a second end 83. Extending between first and second ends 82 and 83 is an intermediate portion 84. Preferably, intermediate portion 84 is provided with a finger or tab element 86 that establishes a notch 87. As will be discussed more fully below, notch 87 serves as an overall travel limiter for first door 52. In addition, first control arm 80 is provided with a camming surface 89 which, in the embodiment shown, is integrally formed with intermediate portion 84. Camming surface 89, in a manner which will be set forth more fully below, establishes various operational positions for first door 52, as well as provides a sealing force that prevents hot oven gases from escaping from oven cavity 6 when doors 52 and 53 are closed.

In a manner similar to that described above, linkage system 68 includes a second control arm 94 having a first end 96 which is pivotally mounted to second door 53 and extends through opening 20 on face frame portion 17 to a second end 97. Extending between first and second ends 96 and 97 is an intermediate portion 98. Intermediate portion 98 is provided with a finger or tab element 100 that establishes a notch 101. Furthermore, in a manner also corresponding to that described above, second arm 94 is provided with a camming surface 103.

In accordance with the embodiment shown, linkage system 68 includes a first tensioning bracket 113 that is pivotally attached to frame 4. First tensioning bracket 113 is provided with a cam follower 115 that is designed to cooperate with camming surface 89 on first control arm 80. More specifically, cam follower 115 includes a rotating member or roller 116 that is adapted to engage with camming surface 89. As will be discussed more fully below, cam follower 115 provides a biasing force against camming surface 89 so that, as first door 52 travels between closed and open positions, camming surface 89 engages with roller 116 to provide a smooth transition. In accordance with one aspect of the invention, camming surface 89 could be provided with various position defining sections or detents (not shown) that enable first door 52 to be situated at various intermediate portions of an opening and/or closing arc. In a similar manner, linkage system 68 includes a second tensioning bracket 117 that is provided with a corresponding cam follower 119 having a rotating member 120. Rotating member 120 is adapted to engage with camming surface 103 on second control arm 94. Actually, when first and second doors 52 and 53 assume the closed position of FIG. 3, cam followers 115 and 119 reside within respective notches 122 and 123 that are established between raised portions 126 and 127 formed on control arms 80 and 94 and camming surfaces 89 and 103. Thus, with the addition of a spring 128 interconnecting first and second tensioning brackets 113 and 117, cam followers 115 and 119 provide a biasing force to first and second control arms 80 and 94. The biasing force not only ensures that frontal opening 14 is effectively sealed when first and second doors 52 and 53 are in the closed position, but assists in opening doors 52 and 53. More specifically, as notches 87 and 101 approach cam followers 115 and 119, the biasing force allows doors 52 and 53 to move to the fully open position without additional assistance, with notches 87 and 101 serving as forward end stops for linkage system 68.

In order to ensure proper operation of the French-style doors, the opening and closing of first and second doors 52 and 53 must be timed to ensure that second door 53 seats upon flange 67 when moved to the closed position. Towards that end, second ends 83 and 97 of control arms 80 and 94 are interconnected so as to define a common pivotal axis 130. That is, first and second ends 83 and 97 are adapted to travel along a common arcuate path in order to establish the necessary timing of first and second doors 52 and 53.

To establish the common arcuate path for second ends 83 and 97, door linkage system 68 includes a stationary control arm or support member 132 having a first end 133 that is fixedly mounted to frame 4 and extends to a second end 134. Support member 132 is interconnected to second ends 83 and 97 of control arms 80 and 94 through a linkage control arm 138. As shown, linkage control arm 138 includes a first end 140 which is pivotally mounted to stationary control arm 132. First end 140 extends to a second end 141 which is pivotally joined with second ends 83 and 97 of first and second control arms 80 and 94. Linkage control arm 138 establishes an overall pivotal arc or path that is traversed by second ends 83 and 97 as first and second doors 52 and 53 are shifted between open and closed positions. Linkage control arm 138 also establishes the necessary timing of both the opening and closing of doors 52 and 53. More specifically, the timing of doors 52 and 53 can be adjusted by either increasing or decreasing the overall length of linkage control arm 138 so as to effect the arcuate path traveled by pivotal axis 130.

Figure 3:
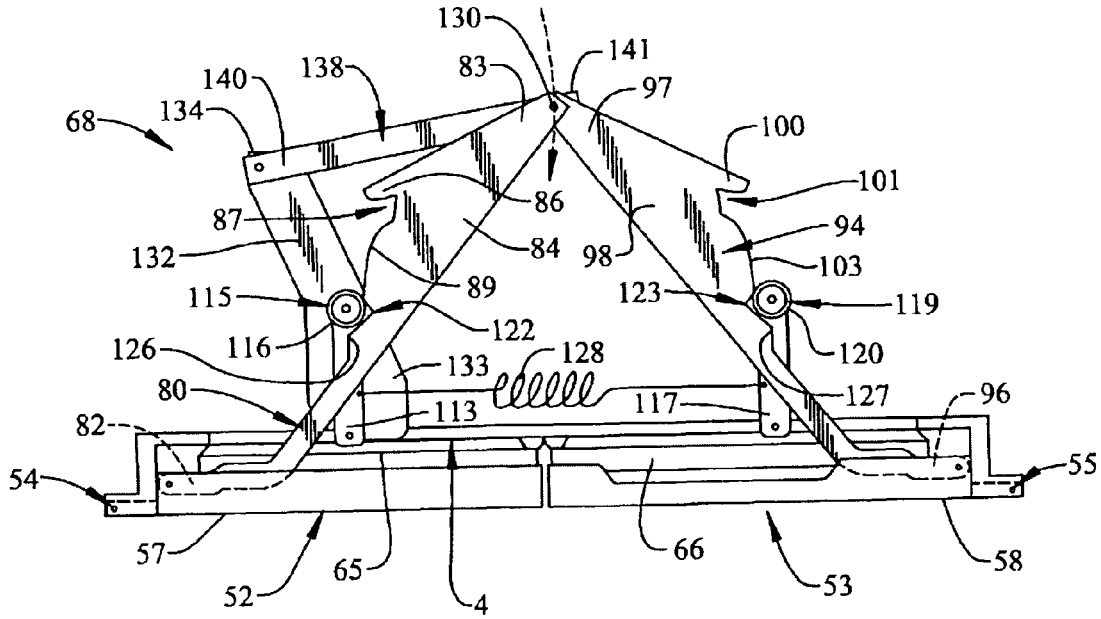
FIG. 3 is a top plan view of a door linkage system according to a first embodiment of the present invention illustrating the doors in a closed position.
Figure 4:
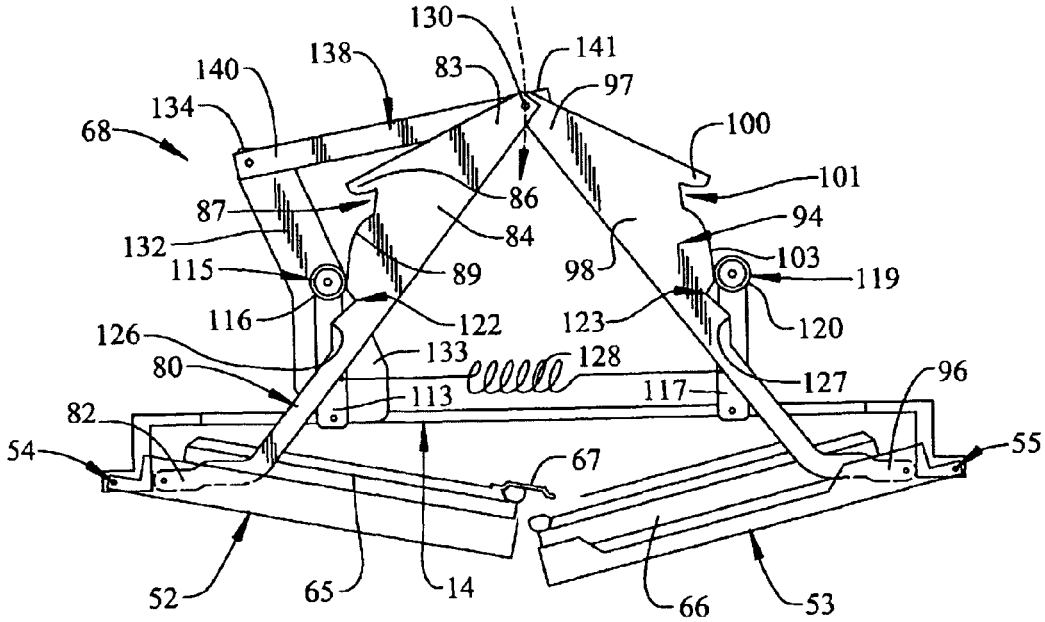
FIG. 4 is a top plan view of the door linkage system of FIG. 3 illustrating the doors moving from the fully closed position towards the fully open position.

Having described the particular structural components of linkage system 68, reference will now be made to FIGS. 3-6 in describing an overall method of operation. As best shown in FIG. 3, when doors 52 and 53 are in fully closed positions, a lobe (not separately labeled) on each camming surface 89 and 103 abuts a respective one of cam followers 115 and 119. First and second tensioning brackets 113 and 117 apply a force generated by spring 128 that urges cam followers 115 and 119 in notches 122 and 123 adjacent camming surface 89 and 103 to maintain doors 52 and 53 in the closed position. Thus, notches 122 and 123 serve as rear end stops for linkage system 68. As doors 52 and 53 begin to transition to an open position as represented in FIG. 4, camming surfaces 89 and 103 begin to move along cam followers 115 and 119 respectively.

Figure 5:
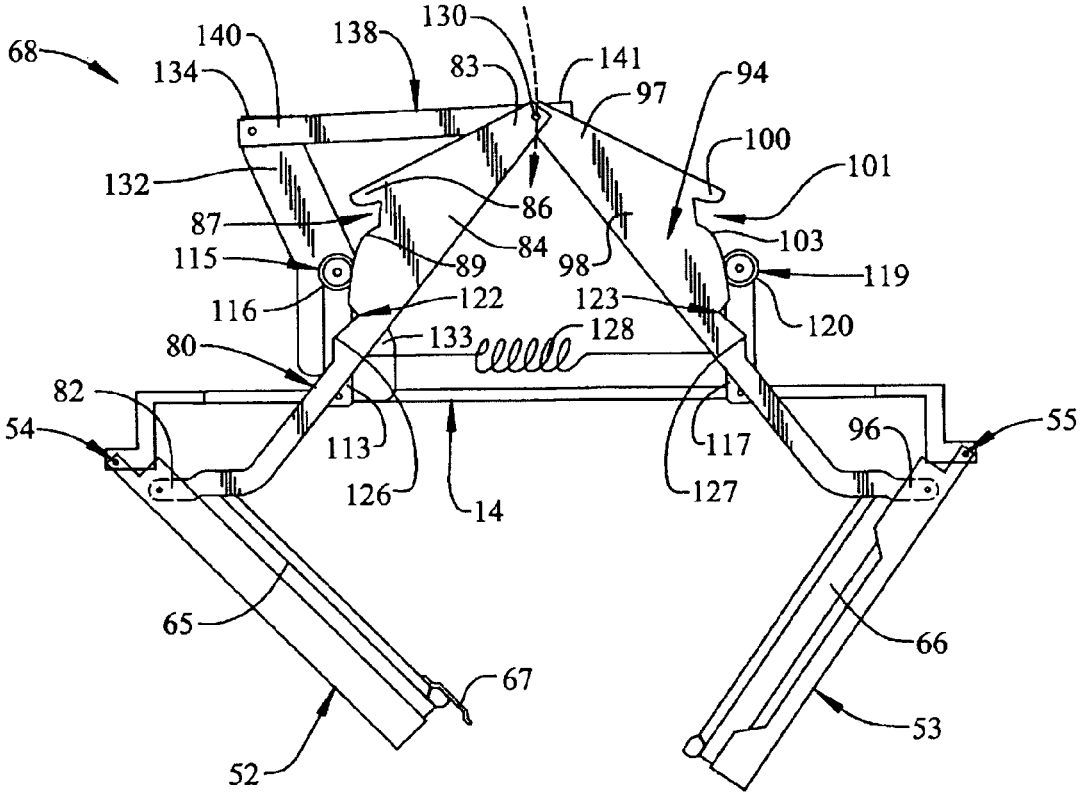
FIG. 5 is a top plan view of the door linkage system of FIG. 4 with the doors moved further towards the fully open position.
Figure 6:
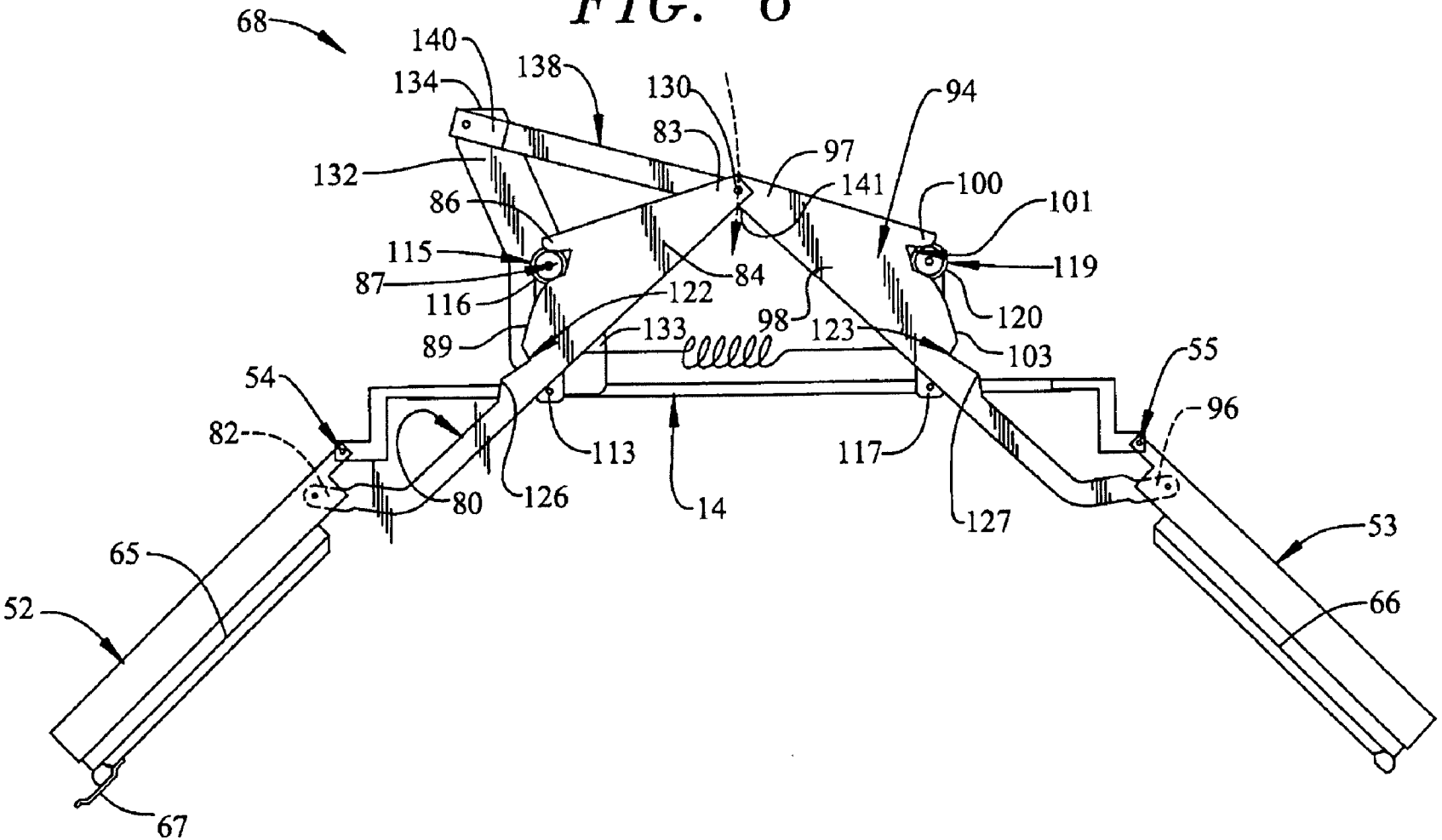
FIG. 6 is a top plan view of the door linkage system of FIG. 5 illustrated in the fully open position.

As indicated above, an opening or closing force applied to either door 52 or 53 will impart a corresponding opening or closing force to the other of doors 52 and 53. As doors 52 and 53 begin to open further, as represented in FIG. 5, camming surfaces 89 and 103 continue to travel along rollers 116 and 120 of cam followers 115 and 119. At the same time, second ends 83 and 97 of door control arms 80 and 94 travel along an arcuate path established by linkage control arm 138 until doors 52 and 53 reach a fully open position as represented in FIG. 6. As doors 52 and 53 near the fully open position, tensioning brackets 113 and 117 apply a force to camming surfaces 89 and 103. The force causes doors 52 and 53 to move to the fully open position without additional assistance given the shapes of camming surfaces 89 and 103. Once in the fully open position, cam followers 115 and 119 rest within notches 87 and 101, thereby preventing doors 52 and 53 from inadvertently swinging closed. At this point, a consumer can easily access oven cavity 6 to either insert or remove a food item. Once the consumer has finished accessing oven cavity 6, a relatively small force, applied to either door 52 or 53, will cause both doors 52 and 53 to move towards the closed position. As set forth above, the arcuate path established by linkage control arm 138 will force door 52 to close just prior to door 53 to ensure the proper sealing of frontal opening 14.

Figure 7:
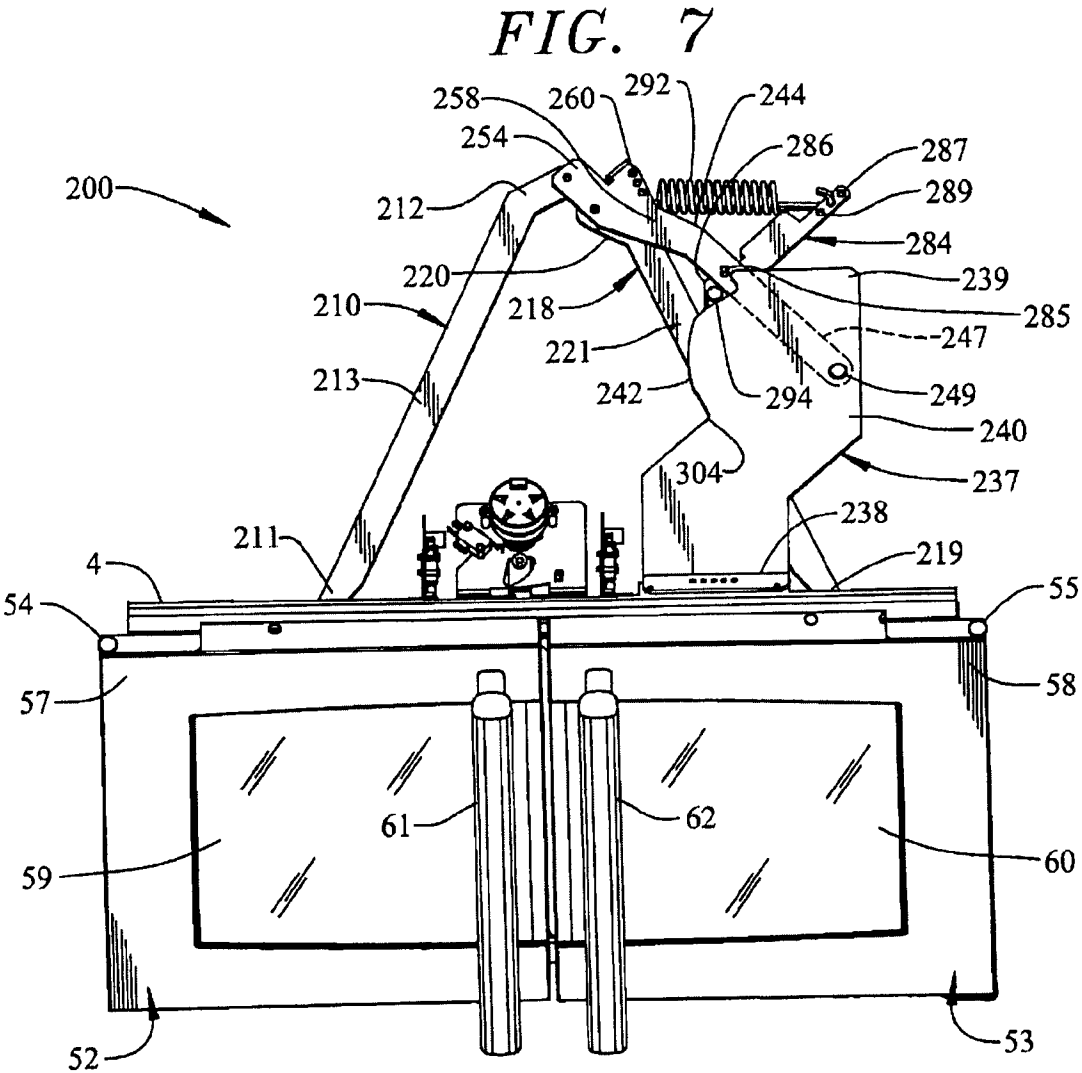
FIG. 7 is an upper perspective view of a door linkage system constructed in accordance with a second embodiment of the present invention with the doors in a closed position.
Figure 8:
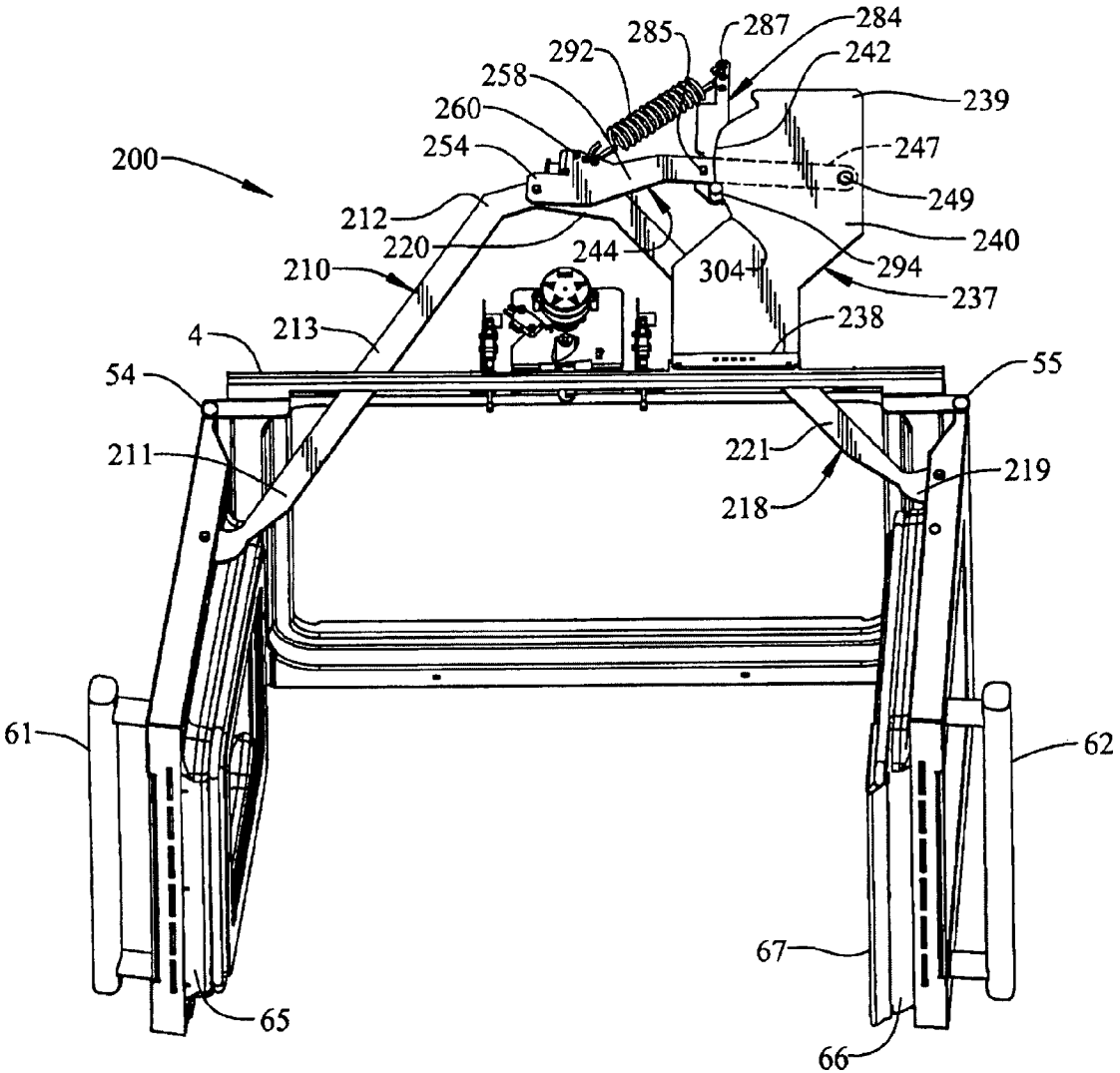
FIG. 8 is an upper perspective view of the door linkage system of FIG. 7 with the doors moving towards a open position.
Figure 9:
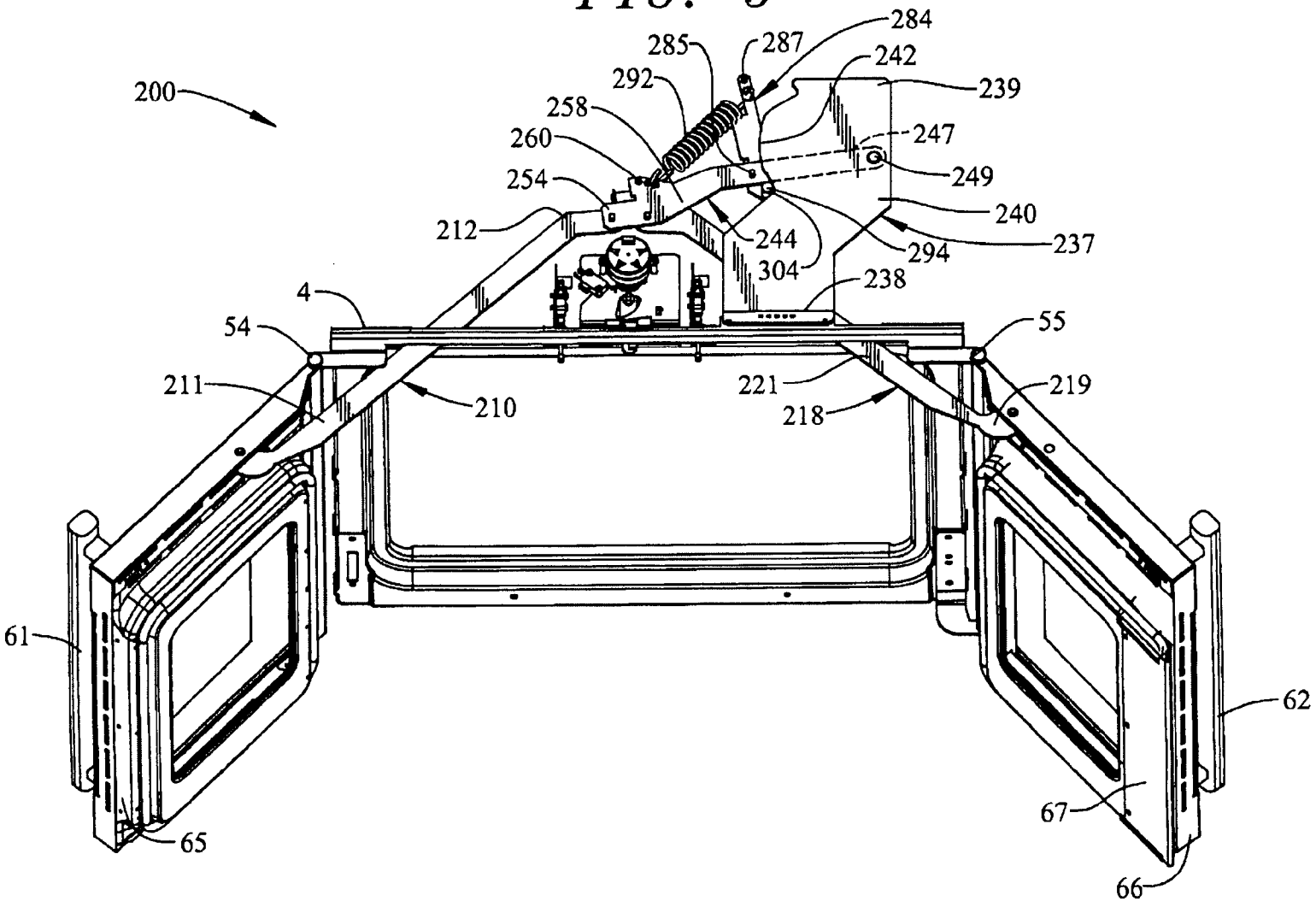
FIG. 9 is an upper perspective view of a door linkage system of FIG. 8 with the doors in a fully open position.

Reference will now be made to FIGS. 7-9, wherein corresponding reference numerals indicate like parts in the respective views, in describing a linkage system 200 constructed in accordance with a second embodiment of the present invention. Linkage system 200 includes a first control arm 210 having a first end 211 which is pivotally connected to door 52 and extends to a second end 212 through an intermediate portion 213. In addition, linkage system 200 includes a second control arm 218 having a first end 219 which is pivotally connected to door 53 and extends to a second end 220 through an intermediate portion 221. In a manner discussed more fully below, first and second control arms 210 and 218 interconnect first and second doors 52 and 53 such that operation of one door, for example door 52, will result in a similar movement to second door 53.

In accordance with the invention, linkage system 200 includes a stationary control arm or support member 237 having a first end 238 fixedly mounted relative to frame 4 and extending to a second end 239 through an intermediate portion 240. In a manner which will be discussed more fully below, a section of intermediate portion 240 includes a camming surface 242. First and second control arms 210 and 218 are operatively connected to support member 237 through a linkage control arm 244. More specifically, linkage control arm 244 includes a first end 247 pivotally connected to intermediate portion 240 of support member 237 at a pivot point or axis 249. First end 247 extends to a second end 254 through an intermediate portion 258. For reasons which will be described more fully below, second end 254 is provided with a plurality of openings, indicated generally at 260.

In accordance with this preferred form of the invention, linkage system 200 includes a tensioning bracket 284 connected to linkage control arm 244 through a pivot pin 285. Tensioning bracket 284 includes a first end 286 that extends to a second end 287. Second end 287 is provided with a plurality of apertures, indicated generally at 289. With this arrangement, a spring 292 is fastened at one of the plurality of apertures 289 and one of the plurality of openings 260 on linkage control arm 244 to provide tension to first and second control arms 210 and 218. More specifically, by selecting between the plurality of apertures 289 and/or plurality of openings 260, a desired tension can be placed on linkage control arm 244. In any event, tensioning bracket 284 is shown to include a cam follower 294 provided at first end 286. As will be described more fully below, cam follower 294 cooperates with camming surface 242 and linkage control arm 244 to guide doors 52 and 53 between a closed position, as represented in FIG. 7, through an intermediate position, as represented in FIG. 8, to a fully open position as represented in FIG. 9.

As best shown in FIG. 7, when doors 52 and 53 are in the closed position, linkage control arm 244 rests upon cam follower 294 with the tension in spring 292 being at a minimum level. As doors 52 and 53 transition towards the intermediate position, linkage control arm 244, through a force provided by first and/or second door control arms 210 and 218, transitions along an arcuate path causing cam follower 294 to travel along camming surface 242. In addition, spring 292 provides tension to first and second control arms 210 and 218 to ensure that doors 52 and 53 do not swing open freely. However, once cam follower 294 passes over a high portion (not separately labeled) of camming surface 242, tensioning bracket 284 aids in shifting doors 52 and 53 to the fully open position. Once doors 52 and 53 reach the fully open position as shown in FIG. 9, cam follower 294 rests at a bottom portion or notch section 304 of camming surface 242. By positioning cam follower 294 in notch section 304, doors 52 and 53 are maintained in a fully open position allowing a consumer to freely introduce a food item into oven cavity 6.

At this point, it is possible to shift doors 52 and 53 to the closed position as represented in FIG. 7. Accordingly, a consumer need operate either door 52 and/or 53 to close cooking appliance 2. That is, by operating either door 52 or 53, a respective control arm 210, 218 exerts a force on linkage control arm 244. Linkage control arm 244 is guided back to the home position, with cam follower 294 moving along camming surface 242. More specifically, tensioning bracket 284, in combination with cam follower 294, ensures that doors 52 and 53 transition smoothly towards the closed position. As cam follower 294 transitions over a top portion (not separately labeled) of camming surface 242, spring 292 pulling on linkage control member 244 aids in the overall closing and sealing of doors 52 and 53.

Based on the above, it should be understood that the present invention provides an adjustable linkage system that can easily alter the closure timing of French-style doors for a cooking appliance. More importantly, the linkage systems as described not only provide flexibility for setting the particular timing of the closing of the doors, but the cam members provide a sealing force to ensure that the frontal opening remains sealed. Furthermore, the particular geometry of the first and second door control arms minimizes the number of pinch points presented to a consumer. Although described with reference to preferred embodiments of the present invention, it should be readily apparent to one of ordinary skill in the art that various changes and/or modifications can be made to the invention without departing from the spirit thereof. For instance, while the control arms are shown interconnected to a stationary control arm through a linkage control arm to establish the arcuate path, other structure could be provided on the oven cabinet shell to serve a similar function. In general, the invention is only intended to be limited to the scope of the following claims.

I claim:

1. A cooking appliance comprising:

a frame;

an oven cavity mounted to the frame, said oven cavity including top, bottom, rear and opposing side walls that collectively define a frontal opening;

first and second doors pivotally mounted relative to the frame about respective, substantially vertical axes for selectively closing the frontal opening of the oven cavity; and a door linkage system interconnecting each of the first and second doors with the frame for synchronized pivotal movement of the doors relative to the frame, said door linkage system including:

a first control arm having a first end pivotally mounted to the first door and a second end;

a second control arm having a first end pivotally mounted to the second door and a second end;

a support member fixed relative to the frame;

a linkage control arm having a first end pivotally mounted to the support member and a second end pivotally interconnected to the second end of each of the first and second control arms;

at least one cam follower mounted for pivotal movement relative to the frame; and a spring element biasing the at least one cam follower against a camming surface defined by at least one of the first control arm, the second control arm and the support member, wherein the first and second doors are pivotable between open and closed positions about the substantially vertical axes and pivoting of either of the first and second doors causes a controlled, synchronized pivoting of the other of the first and second doors through the door linkage system.

2. The cooking appliance according to claim 1, wherein the door linkage system includes at least one tensioning bracket having a first end pivotally mounted relative to the frame, said at least one cam follower being mounted for pivotal movement relative to the frame through the tensioning bracket.

3. The cooking appliance according to claim 2, wherein the at least one cam follower constitutes first and second cam followers, with each of the first and second control arms having a respective camming surface adapted to ride against respective ones of the first and second cam followers when either the first or second door is operated.

4. The cooking appliance according to claim 3, wherein each of the first and second cam followers is mounted to first and second tensioning brackets, each of said first and second tensioning brackets being pivotally mounted relative to the frame and biased together by the spring element.

5. The cooking appliance according to claim 1, wherein at least one of the first and second control arms includes a finger element, said finger element establishing a notch which is adapted to receive the at least one cam follower to serve as a travel limiter.

6. The cooking appliance according to claim 2, wherein the second end of the at least one tensioning bracket includes a mounting aperture having connected thereat the spring element.

7. The cooking appliance according to claim 6, wherein the second end of the at least one tensioning bracket is coupled to the second end of the linkage control arm through the spring element.

8. The cooking appliance according to claim 7, wherein the second end of the linkage control arm includes a plurality of spring receiving apertures, said spring element being connected to a select one of the spring receiving apertures to set a desired tension for the linkage control arm.

9. The cooking appliance according to claim 6, wherein the camming surface is integrally formed on the support member.

10. The cooking appliance according to claim 9, wherein the cam follower is mounted to the tensioning bracket, said cam follower being adapted to engage the linkage control arm while moving along the camming surface as the first and second doors move between fully closed and fully open positions.

11. The cooking appliance according to claim 10, wherein the camming surface includes an end stop, said cam follower being adapted to nest against the end stop when the first and second doors are in the fully closed position.

12. The cooking appliance according to claim 10, wherein the camming surface includes a forward end stop, said cam follower being adapted to nest against the forward end stop when the first and second doors are in a fully open position so as to ensure that the first and second doors do not inadvertently shift toward the fully closed position.

13. A cooking appliance comprising:

a frame;

an oven cavity mounted to the frame, said oven cavity including top, bottom, rear and opposing side walls that collectively define a frontal opening;

first and second doors pivotally mounted relative to the frame about respective, substantially vertical axes for selectively closing the frontal opening of the oven cavity; and a door linkage system interconnecting each of the first and second door with the frame, said doors linkage system including a first control arm having a first end pivotally mounted to the first door extending to a second end, a second control arm having a first end pivotally mounted to the second door and a second end pivotally interconnected to the second end of the first control arm, at least one cam follower mounted to the frame and a linkage control arm having a first end mounted to pivot about a fixed point relative to the frame and a second end pivotally interconnected to the second ends of the first and second control arms, each of said second ends of the first and second control arms being mounted so as to travel along respective arcuate paths defined, at least in part, by the linkage control arm wherein, when one of the first and second doors is operated, movement of the one of the first and second doors in either an opening or a closing direction causes the second ends of the first and second control arms to translate along the respective arcuate paths causing another of the first and second doors to move in either the opening or closing direction, with at least one of the first and second control arms being adapted to engage the cam follower when the first and second doors are shifted.

14. The cooking appliance according to claim 13, wherein each of the second ends of the first and second control arms are directly pivotally interconnected.

15. The cooking appliance according to claim 13, wherein the door linkage system includes a stationary control arm having a first end fixedly attached to the frame and a second end, said first end of the linkage control arm being pivotally secured to the second end of the stationary control arm.

16. The cooking appliance according to claim 15, wherein the is at least one cam follower pivotally mounted relative to the frame, and the at least one of the first and second control arms rides against the cam follower when the first and second doors are shifted.

17. The cooking appliance according to claim 16, wherein the door linkage system includes first and second cam followers pivotally mounted relative to the frame, said first and second cam followers being biased together by a spring element.

18. The cooking appliance according to claim 15, wherein the at least one cam follower travels along a door position cam provided on one of the first and second control arms.

19. The cooking appliance according to claim 18, wherein at least one of the first and second control arms includes a finger element, said finger element establishing a notch which serves as a travel limiter for the first and second doors.

20. The cooking appliance according to claim 19, wherein at least one of the first and second control arms includes another notch, said another notch serving to limit an overall degree of travel of the first and second doors.

21. The cooking appliance according to claim 18, wherein each of the first and second control arms is provided with a respective said door position cam.

* * * * *